United States Patent [19]

Radtke et al.

[11] 4,140,821

[45] Feb. 20, 1979

[54] PROCESS FOR PREHEATING AND PREPARING FERROUS METAL FOR GALVANIZING

[75] Inventors: Schrade F. Radtke, New Canaan, Conn.; David C. Pearce, Bernardsville, N.J.

[73] Assignee: International Lead Zinc Research Organization, Inc., New York, N.Y.

[21] Appl. No.: 664,359

[22] Filed: Mar. 5, 1976

[51] Int. Cl.[2] ..... C23C 1/02; C23C 1/12

[52] U.S. Cl. ..... 427/310; 427/321; 148/26

[58] Field of Search ..... 427/310, 321; 148/23, 148/26

[56] References Cited

U.S. PATENT DOCUMENTS

| | | | |
|---|---|---|---|
| 2,278,600 | 4/1942 | Wean | 427/311 |
| 2,428,523 | 10/1947 | Marshall | 427/311 |
| 2,940,870 | 6/1960 | Baldwin | 117/52 |
| 3,244,551 | 4/1966 | Heins | 117/52 |
| 3,260,619 | 7/1966 | Shoemaker et al. | 134/3 |
| 3,617,455 | 11/1971 | Shoemaker | 204/145 |
| 3,816,188 | 6/1974 | Chay | 148/26 |
| 3,936,540 | 2/1976 | James | 427/310 |
| 3,941,906 | 3/1976 | Bostroem | 427/433 |
| 3,952,120 | 4/1976 | Horton | 427/433 |

FOREIGN PATENT DOCUMENTS

| | | | |
|---|---|---|---|
| 10860 of | 1845 | United Kingdom | 427/310 |

OTHER PUBLICATIONS

Galvanizing (Hot-Dip), Heinz Bablik, 3rd Edition, 1950, E & F.N. Spon Ltd, p. 58.

*Primary Examiner*—Ralph S. Kendall
*Attorney, Agent, or Firm*—Brumbaugh, Graves, Donohue & Raymond

[57] ABSTRACT

A process for simultaneously preheating and preparing a ferrous surface, prior to the depositing thereon of galvanized zinc coatings, replaces conventional fluxing techniques with the step of immersing a ferrous object in a bath of a molten salt or salts. The salts are chosen so that they are liquid at a temperature below that of the zinc coating step. The liquid acts as a non-fuming flux and preheat for the surface. Particular salts include metallic hydroxides and halides.

16 Claims, 9 Drawing Figures

PROCESS FOR PREHEATING AND PREPARING FERROUS METAL FOR GALVANIZING

BACKGROUND OF THE INVENTION

This invention relates to the preparation of the surfaces of ferrous metal parts for depositing thereon galvanized zinc coatings. The galvanizing process requires that the surface of the ferrous object be properly prepared before immersing in the zinc bath, to ensure a metallurgical bond between the ferrous surface and the zinc. Present industrial preparation techniques may be divided into two groups: processes using a flux, and processes using gaseous reduction of oxide coating on the surface, e.g., the Sendzimir process. The new concept for the preparation of the surface, herein described, is a variation on the fluxing technique. A "flux" as herein used is a substance that promotes the fusing of metals.

The two fluxing processes now commercially used are referred to as the "dry method" and the "wet method". These industry names are somewhat misleading in that the terms "dry" and "wet" are not actually descriptive of the techniques: in the "dry" method the flux is placed on the ferrous object by immersing the object in a hot aqueous zinc chloride-ammonium chloride flux solution prior to entering the zinc bath; while in the "wet" method the flux is placed on top of the zinc bath, and the ferrous object to be galvanized is passed through it into the zinc.

While the above-described processes have for many years been producing satisfactory galvanized products, there are several inherent drawbacks to them. For instance, the reaction by which the zinc chloride-ammonium chloride flux promotes the galvanizing process produces visible, voluminous gaseous emissions. While these emissions have not been found to be toxic, they are irritating to workers on continued, excessive exposure and, therefore, are coming under scrutiny by governmental agencies such as the U.S. Environmental Protection Agency and the Occupational Safety and Health Administration.

The fluxing processes require the immersion of a relatively cold object (typically below 95° C., or 203° F.) into the molten zinc bath (typically about 460° C., or 860° F.). The result is a lowering of the zinc temperature by, for example, 5° to 11° C., or 10° to 20° F. Thus, the molten zinc and the object must be reheated to the temperature at which galvanizing is to occur. This temperature recovery requires that the heat input to the galvanizing kettle be increased to raise the temperature in a relatively short time, thus decreasing the ability of the galvanizer to control the temperature of the bath within desired limits. The increased heat input through the walls of the kettle also shortens its life. Further, undue time must be spent for this recovery, thus decreasing the productivity of the bath. Finally, the inability to control closely immersion times removes one of the most important parameters that the galvanizer can use to regulate the weight of coatings.

In recent years the galvanizer has been called upon to handle ferrous metals of a wide variety of chemical compositions, and the various ferrous metals react with different rates in the galvanizing bath. This difference in behavior is especially crucial in the case of ferrous metals containing silicon. The normal galvanizing times and temperatures used for galvanizing rimmed steels (low silicon content) can produce excessively heavy, brittle coatings on silicon-containingferrous metals. This problem is particularly troublesome in objects consisting of several different types of ferrous metals welded or assembled together. Thus, to prevent this the galvanizer is required to control carefully the immersion time and temperature in the zinc bath. These controls are extremely difficult, if not impossible, to obtain with the present galvanizing processes.

Also, in recent years galvanizers have been called upon to handle more complex shapes. The shapes often involve parts of widely different cross-sections. When introduced into the molten zinc, the thinner sections heat more rapidly and galvanize to a greater coating thickness than the heavier parts. The coatings on the thin sections are then excessively thick when the coatings on the heavy parts meet the minimum thickness.

BRIEF SUMMARY OF THE INVENTION

A new galvanizing process has been invented whereby a molten salt or metallic hydroxide has been substituted for the fluxing techniques normally used in galvanizing. The process uses a non-fuming salt or metallic hydroxide bath as both a preheat and a surface preparation medium for the ferrous metal object prior to its entering the galvanizing bath. This process not only overcomes a number of the objectionable features of the present fluxing techniques, but offers a method by which the coating weights on silicon-containing ferrous metals may be controlled so that the galvanizer does not have to take special precautions when galvanizing a variety of ferrous metals.

DETAILED DESCRIPTION OF THE INVENTION

Figure 1:
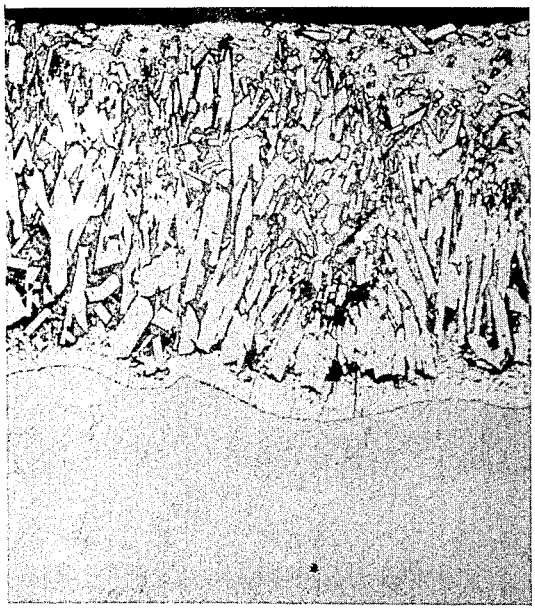
FIG. 1 shows a photomicrograph of the crystalline structure obtained on the steel surface following fluxing by using the conventional "dry" technique.

The use of the invention herein described for the preparation of the ferrous metal surface eliminates the problems described above. In the improved galvanizing process incorporating the invention, the surface may first be cleaned, by means well-known in the art such as a caustic soda wash, or a shot or abrasive blast. The surface also may be pickled and rinsed, again as is well-known in the art. Next, the ferrous metal object is immersed in a bath of molten salt or metallic hydroxide. The effectiveness of this bath as a preheat and preparation depends on the selection of the proper salts and metallic hydroxides. By "salts and metallic hydroxides" we henceforth intend to designate combinations thereof as well.

Investigations have identified several requirements for the bath, namely that it (1) be molten at the lowest galvanizing temperatures, (2) act as a flux for the surface of the ferrous metal part, (3) produce no visible or offensive fumes, (4) remain chemically stable over long periods of use, and (5) have minimal corrosive attack on the ordinary container materials such as steel or cast iron kettles. In general, it has been found that the bath may contain salts or metal hydroxides, or combinations thereof; more specifically, alkali metal hydroxides and halide salts may be used. As particular examples, sodium hydroxide, and combinations of the chlorides of lithium, sodium, potassium, zinc, and lead meet the above requirements. Sodium hydroxide is a preferred medium for the bath, as are four particular pairs of salts, as follows: zinc chloride, from 55% (by weight) to 77 wt.%, plus potassium chloride, from 45 wt.% to 23 wt.%, and preferably about 65 wt.% zinc chloride and about 35 wt.% potassium chloride; potassium chloride, from 49 wt.% to 59 wt.%, plus lithium chloride, from 51 wt.% to 41 wt.%, preferably about 55 wt.% potassium chloride and about 45 wt.% lithium chloride; lead chloride, from 75 wt.% to 95 wt.%, plus potassium chloride, from 25 wt.% to 5 wt.%, and preferably either about 92 wt.% lead chloride and about 8 wt.% potassium chloride, or about 80 wt.% lead chloride and about 20 wt.% potassium chloride; also, lead chloride, from 90 wt.% to 95 wt.%, plus sodium chloride, from 10 wt.% to 5 wt.%, preferably about 91 wt.% lead chloride and about 9 wt.% sodium chloride.

The ferrous metal object is allowed to remain immersed in the bath, in order to preheat it. The bath is maintained at a temperature above its melting point, so that immersion therein of the cooler metal object will not cause the bath to solidify. The object should be brought to at least the temperature at which the bath melts. In this way, the heat loss in the zinc bath caused by the object is lessened considerably. This advantage is further realized by heating the object in the preheat bath to at least a temperature 100° C. (180° F.) below that of the zinc bath. More preferably, the object can be preheated to at least a temperature 20° C. (36° F.) below that of the zinc bath. In the preferred embodiment, the object is heated to a temperature at least about that of the zinc bath. The expression of the temperature of the object as a function of the zinc bath temperature applies in the normal commercial range of zinc temperatures of 450° C. to 470° C. (842° F. to 878° F.), as well as temperatures above or below this range. The length of time required for the immersion of the object in the bath will vary, depending on the size of the object, and the size and the temperature of the preheat bath. This length of time is readily calculable by the galvanizer, who may monitor the temperature of the object while it is in the preheat bath, for example by using a thermocouple mounted within the object. The times will be on the order of several minutes or more.

Two bath compositions will be identified below for the purposes of providing examples which will demonstrate the advantages of the proposed process. However, it is not our intention to imply that only these baths are applicable to the proposed process. The two baths are caustic soda (NaOH), which melts at 318° C. (605° F.), and a mixture comprising about 65 wt.% zinc chloride and about 35 wt.% potassium chloride, which mixture melts at 230° C. (446° F.).

Figure 2:
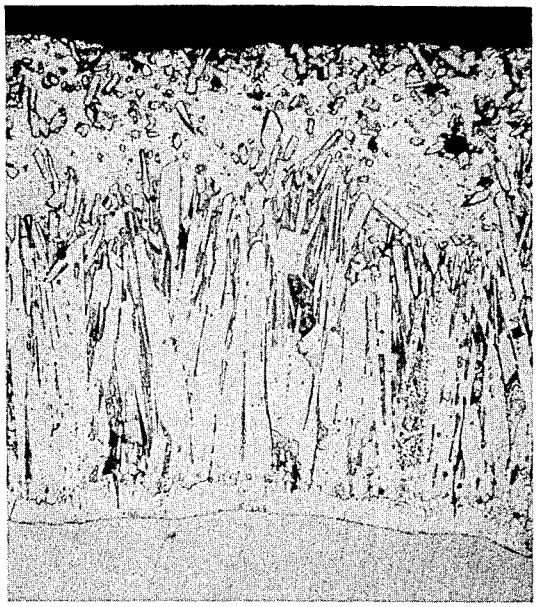
FIGS. 2 and 3 are photomicrographs of the crystalline structure obtained using the present invention employing two particular baths.
Figure 3:
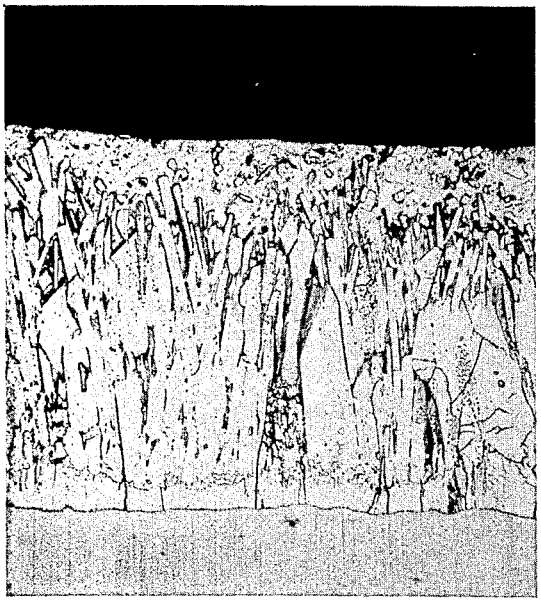

Each compound was melted and used as a preheat bath for various ferrous metal objects prior to galvanizing. FIG. 1 illustrates the coating microstructures obtained on galvanized steel after using a standard "dry" fluxing technique. Comparison with FIG. 2 or 3, showing the microstructures on the same steel after using, respectively, the zinc chloride-potassium chloride mixture, and caustic soda, shows the microstructures are essentially identical, illustrating the fact that the bath preheat does flux steel, promoting the essential reaction between the ferrous metal object and the molten zinc.

The two baths described above were found to be chemically stable when held at temperatures of 450° C. (842° F.) for extended periods of time, namely two to three months. Neither bath was found to emit visible fumes other than when other volatile impurities were brought into the bath with the ferrous metal object.

Figure 4:
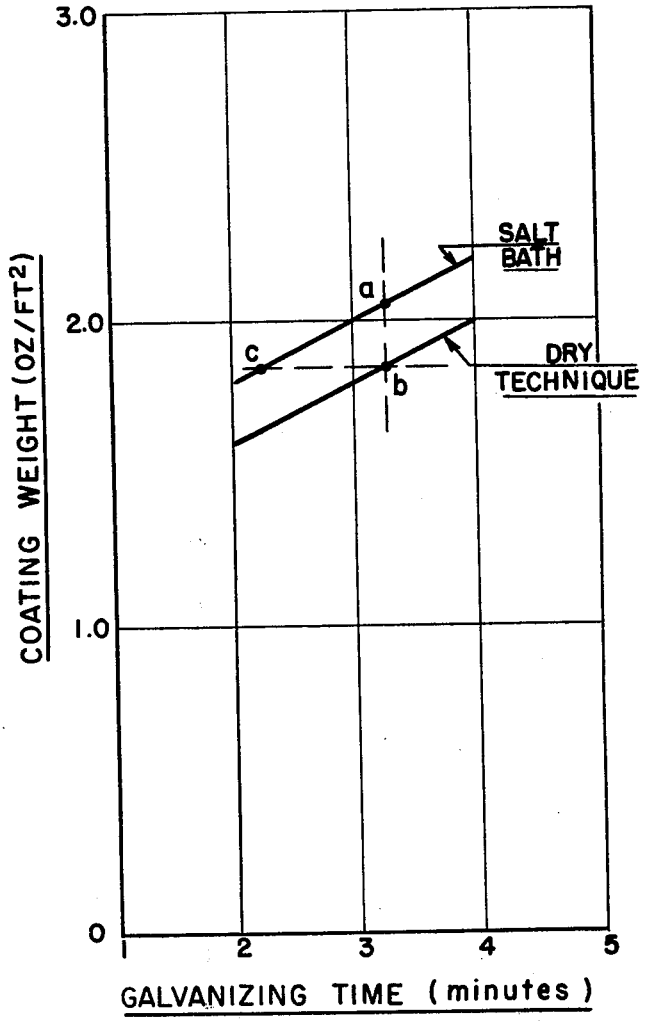
FIGS. 4 through 9 are graphs illustrating the improved galvanizing process operating conditions obtained using the present invention, as compared to known fluxing techniques.

FIG. 4 illustrates the coating weights obtained on a typical structural steel as a function of the immersion time. The curves represent the results obtained using the standard "dry" process and the salt bath preheat, using a bath of about 65 wt.% zinc chloride and about 35 wt.% potassium chloride. For any given immersion time the salt bath preheat specimen obtained a heavier coating weight than the conventionally fluxed specimen (see point a versus point b). Conversely, a given coating weight can be obtained after a shorter immersion time in the zinc bath by using the salt bath preheat than by using the conventional fluxing technique (point c versus point b).

Figure 5:
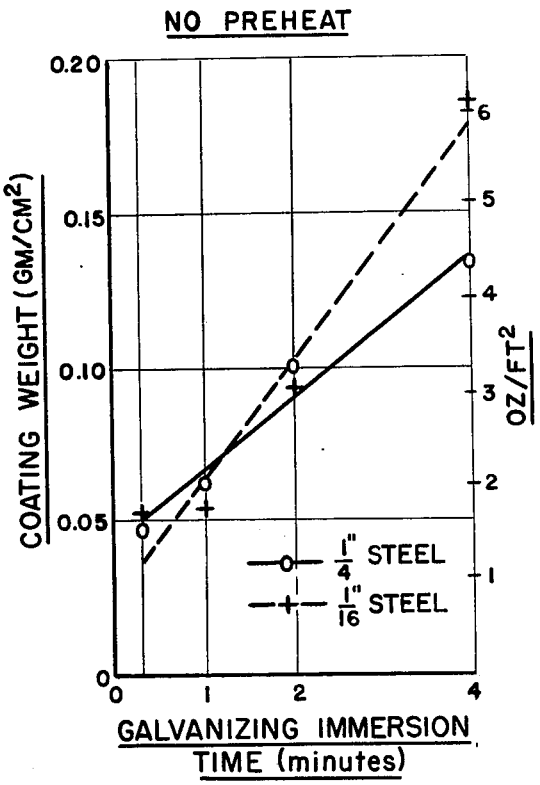
Figure 6:
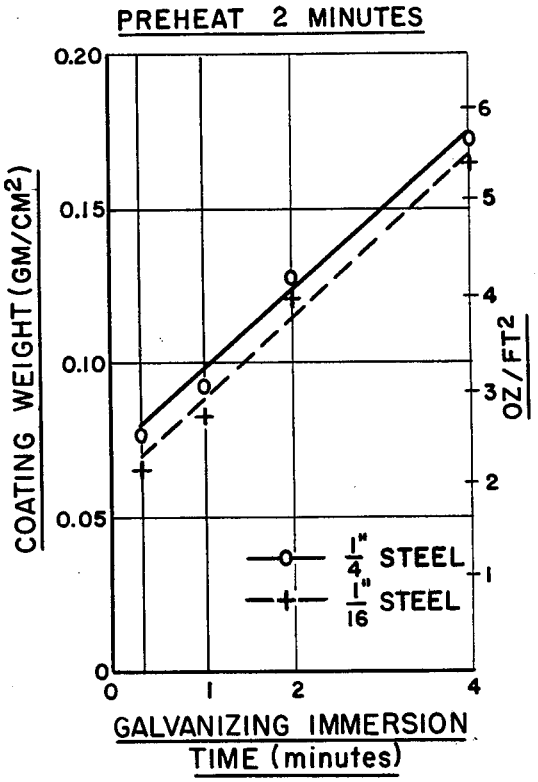
Figure 7:
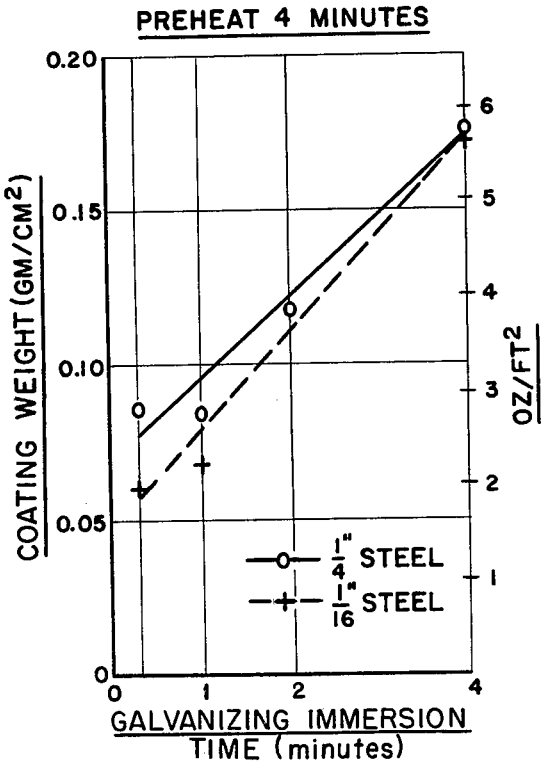

A model work piece fabricated from steel parts of widely different section thickness was galvanized in one case using the standard "dry" technique, and another using a molten salt bath containing about 65 wt.% zinc chloride and about 35 wt.% potassium chloride as a preheat. As seen from the curves in FIGS. 5, 6 and 7, a more uniform coating distribution was obtained in the latter cases. The curves show that the coating weights on the thin sections and the heavy sections are more nearly the same as the time of immersion in the zinc bath increases when a salt bath preheat is used than when the "dry" technique is used.

One type of ferrous metal commonly galvanized is known as rimmed steel and is low in silicon content (less than about 0.01% silicon); while other known as semi- or fully-killed steels contain considerable amounts of silicon (0.01% to 1%). These latter steels are known to be more reactive in the zinc bath, obtaining much heavier coating weights than the rimmed steel when using conventional galvanizing techniques.

Figure 8:
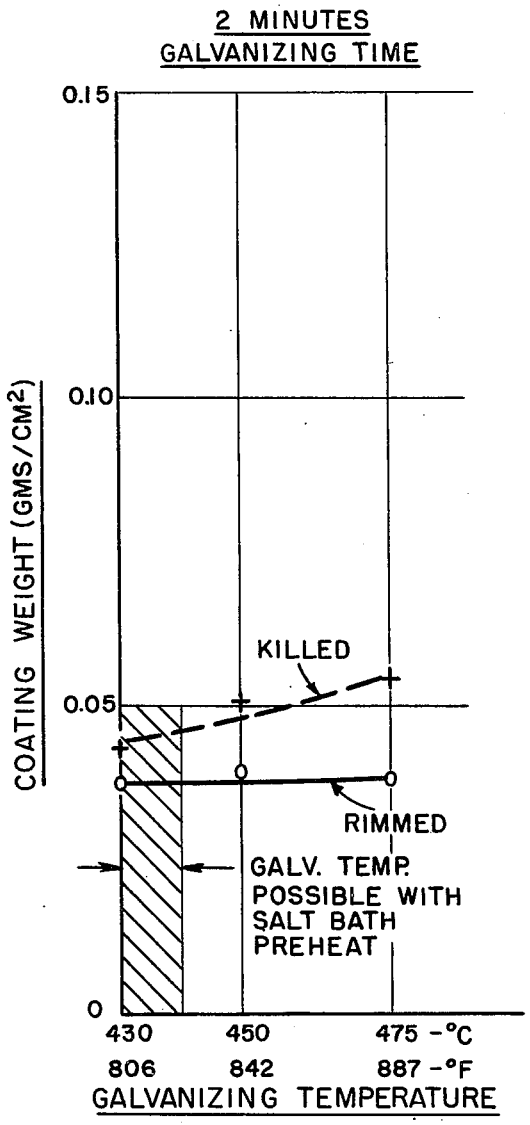
Figure 9:
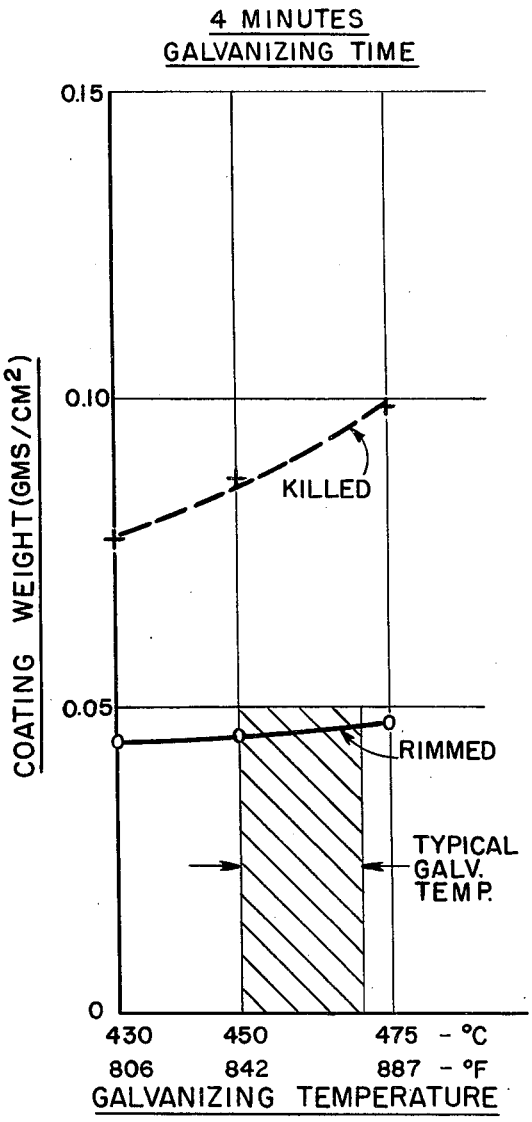

The preheat bath permits the lowering of two parameters important to the control of galvanized coating thickness, i.e., time and temperature. For example, an experiment was conducted using a rimmed steel and a fully-killed steel (about 0.5% silicon) in which these two parameters were varied. It is shown in FIGS. 8 and 9 that a shortening of the galvanizing time from four to two minutes, and a lowering of the zinc bath temperature range from the typical commercial practice of between 450° C. and 470° C. (842° F. and 878° F.) to the range between 430° C. and 440° C. (806° F. and 824° F.) are both possible with a preheat bath (in this example containing about 65 wt.% zinc chloride and about 35 wt.% potassium chloride), and give approximately the same coating thicknesses for rimmed and fully-killed steels. Thus, the galvanizer, by maintaining lower temperatures and shorter periods of immersion during galvanizing, can meet the specified thickness requirements and still obtain comparable coating growths from both silicon-containing and non-silicon-containing metals. This advantage is also available when the object to be galvanized consists of two or more different kinds of ferrous metal welded or assembled together.

We claim:

1. An improved process for galvanizing the surface of a ferrous object, in which a coating of zinc is deposited on said surface in a molten zinc bath, wherein the improvement comprises, prior to the zinc depositing step, immersing the object in a preheat bath, consisting essentially of a molten inorganic salt or sodium hydroxide or mixtures thereof of the type which melts at a temperature below that of the zinc bath, said preheat bath having a temperature above its melting point and above the temperature of the zinc bath, wherein said immersion lasts for an amount of time sufficient to preheat said ferrous object to a least the temperature of the zinc bath, whereby said preheat bath acts as a non-fuming flux for said surface, and thereafter removing said object from said preheat bath and immersing it into the bath containing molten zinc.

2. A process according to claim 1 in which said bath contains sodium hydroxide.

3. A process according to claim 1 in which said bath contains a halide salt.

4. A process according to claim 3 in which said bath contains a chloride of lithium, sodium, potassium, zinc, or lead.

5. A process according to claim 4 in which said bath contains from 55% to 77% by weight zinc chloride, and from 45% to 23% by weight potassium chloride.

6. A process according to claim 5 in which said bath contains about 65 wt.% zinc chloride and about 35 wt.% potassium chloride.

7. A process according to claim 4 in which said bath contains from 49% to 59% by weight potassium chloride and from 51% to 41% by weight lithium chloride.

8. A process according to claim 7 in which said bath contains about 55 wt.% potassium chloride and about 45 wt.% lithium chloride.

9. A process according to claim 4 in which said bath contains from 75% to 95% by weight lead chloride and from 25% to 5% by weight potassium chloride.

10. A process according to claim 9 in which said bath contains about 92 wt.% lead chloride and about 8 wt.% potassium chloride.

11. A process according to claim 9 in which said bath contains about 80 wt.% lead chloride and about 20 wt.% potassium chloride.

12. A process according to claim 4 in which said bath contains from 90% to 95% by weight lead chloride and from 10% to 5% by weight sodium chloride.

13. A process according to claim 12 in which said bath contains about 91 wt.% lead chloride and about 9 wt.% sodium chloride.

14. A process according to claim 1 in which said ferrous object contains from about 0.01% to about 1% silicon.

15. A process according to claim 1 in which said ferrous object comprises two or more pieces of ferrous metal of different compositions welded or assembled together.

16. A process according to claim 1 in which said object has widely different cross-section thicknesses.

* * * * *